US008143191B2

(12) United States Patent
Aihara

(10) Patent No.: US 8,143,191 B2
(45) Date of Patent: Mar. 27, 2012

(54) THERMOSENSITIVE RECORDING MATERIAL

(75) Inventor: Hideo Aihara, Fuji (JP)

(73) Assignee: Ricoh Company, Ltd., Tokyo (JP)

( * ) Notice: Subject to any disclaimer, the term of this patent is extended or adjusted under 35 U.S.C. 154(b) by 566 days.

(21) Appl. No.: 12/396,185

(22) Filed: Mar. 2, 2009

(65) Prior Publication Data

US 2009/0239746 A1 Sep. 24, 2009

(30) Foreign Application Priority Data

Mar. 18, 2008 (JP) ..... 2008-069096

(51) Int. Cl.
*B41M 5/30* (2006.01)
*B41M 5/42* (2006.01)

(52) U.S. Cl. ..... 503/226; 503/200

(58) Field of Classification Search ..... None
See application file for complete search history.

(56) References Cited

U.S. PATENT DOCUMENTS

| | | | |
|---|---|---|---|
| 5,792,724 | A | 8/1998 | Suzaki et al. |
| 5,866,507 | A | 2/1999 | Suzaki et al. |
| 5,935,899 | A | 8/1999 | Suzaki et al. |
| 5,952,263 | A | 9/1999 | Suzaki et al. |
| 6,770,430 | B1 | 8/2004 | Kubo |
| 2003/0054142 | A1 | 3/2003 | Yamamoto et al. |
| 2004/0180789 | A1 | 9/2004 | Yamamoto et al. |

FOREIGN PATENT DOCUMENTS

| | | | |
|---|---|---|---|
| EP | 1079271 | A1 | 2/2001 |
| EP | 1228892 | A2 | 8/2002 |
| JP | 6-234270 | | 8/1994 |
| JP | 2002-248864 | | 9/2002 |
| JP | 2005-81626 | | 3/2005 |
| JP | 2006-289962 | | 10/2006 |
| JP | 3900274 | | 1/2007 |

OTHER PUBLICATIONS

Jul. 6, 2009 European search report in connection with a counterpart European patent application No. 09 15 5349.
U.S. Appl. No. 06/874,950; filed Jun. 16, 1986 (abandoned).

*Primary Examiner* — Bruce H Hess
(74) *Attorney, Agent, or Firm* — Cooper & Dunham, LLP

(57) ABSTRACT

A thermosensitive recording material including a polypropylene film support, a thermosensitive recording layer, a protective layer and a back layer, where the thermosensitive recording layer and the protective layer are disposed on a surface of the polypropylene film support, and the back layer is disposed on another surface of the polypropylene film support, where the back layer is a coated layer of a coating liquid containing a self-crosslinking resin emulsion, which contains a combination of at least one selected from a carbonyl group-containing acrylic resin having a Tg of 16° C. or lower and a copolymer polyester resin having a Tg of 16° C. or lower and a hydrazine derivative having a hydrazine residual group, and a quaternary ammonium polymer antistatic agent.

5 Claims, No Drawings

THERMOSENSITIVE RECORDING MATERIAL

BACKGROUND OF THE INVENTION

1. Field of the Invention

The present invention relates to an improvement of a back layer of a thermosensitive recording material having a support made of a polypropylene film, in other words, to a thermosensitive recording material which is excellent in binding property, antistatic property, and adhesion of water-resistant adhesive, and which is free from the blocking to the surface of the thermosensitive recording material in a wound-up state.

2. Description of the Related Art

Recently, the diversification of information and enlargement of needs have urged the study and development of various recording materials in the field of information recording, and various materials have been put to practical use. Among them, a thermosensitive recording material is advantageous in that:

(1) it allows easy recording of images with mere heating process, (2) a device therefor can have a simple mechanism and can easily be downsized; and (3) it is easy to handle and inexpensive.

Accordingly, a thermosensitive recording material is widely utilized in various fields, including data processing (the output of a desk-top calculator, computer, or the like), a recorder for a medical measurement, a low-speed or high-speed facsimile, a ticket vending machine (railway ticket, admission ticket, or the like), a thermal copying, a label for a POS system, a tab, and so on.

Typically, the thermosensitive recording material has, on a paper support, a layer containing a color former which generates a coloring reaction by heat. However, a synthetic paper or synthetic resin film is used as a support in view of dimensional stability, physical strength, and insolubility to water, which are properties required for a recording paper. However, since such a film support as synthetic paper support has high electric resistance compared to a paper support, it tends to generate static electricity by the friction with a platen roll, a thermal head, or the like when the recording material is conveyed for the printing in a printer, followed by a running fault such as jamming, a damage of the thermal head, or the like.

Since such static electricity is mainly generated by the friction between a platen roll and a recording material, an antistatic agent has commonly been applied onto the back side of a thermosensitive recording material, the surface to be contacted with platen rolls. Examples of the antistatic agents used include (1) inorganic salts such as sodium chloride, (2) anionic polymer electrolytes such as sodium polystyrene sulfonate, and (3) conductive metallic compounds such as conductive zinc oxide and tin oxide.

However, inorganic salts (1) and anionic polymer electrolytes (2) are less effective for the amount used, and are sticky under a high humidity condition and easy to dissolve into water because of their nature as electrolytes. Conductive metallic compounds (3) are not affected by humidity and are capable of displaying a desired effect even with a slight amount; however, they have a serious drawback in chemical safety as a thermosensitive recording material.

Meanwhile, especially in the field of POS label, tag, and CAD, there is a demand for a thermosensitive recording material satisfying concurrently properties such as physical strength against bending or breaking, dimension stability, and water-insolubility so as to meet requirements in the field.

In view of such requirements, Japanese Patent Application Laid-Open (JP-A) No. 06-234270 discloses a thermosensitive recording material having, on the back surface, an antistatic layer containing as main components a quaternary salt polymer, a water-soluble resin, and a water-resistance imparting agent. The thermosensitive recording material is described as having an antistatic property and water resistance, reducing occurrence of running failure and occurrence of a thermal head damage, showing no sticking under a high humidity condition, and having a high chemical safety.

However, this thermosensitive recording material has drawbacks that the adhesion between the antistatic layer, the support and an adhesive layer is so weak that the antistatic layer easily peels off from the support. It also has a drawback that, after dipping in water, the antistatic layer or the adhesive layer is easily peeled off from the support only by rubbing it with a finger. This is a serious problem in the case where an adhesive layer and a release paper are successively laminated.

In addition, the back surface easily adheres to a surface while the recording material is stored in the form of a roll after a coating process, so that the coated layer disposed either on the front or back surface tends to peel off after the recording material is unwound.

JP-A No. 2002-248864 discloses a thermosensitive recording material having, between the support and the heat developing layer and/or on the back surface of the support, an antistatic layer containing a quaternary salt polymer and an acryl-composite urethane resin, in order to obtain a thermosensitive recording material excellent in a film strength, running performance, and water resistance.

JP-A No. 2005-81626 discloses a thermosensitive recording material having a back layer containing a non-foaming plastic hollow filler, a styrene-acryl copolymer having an acid value of 200 or more and a glass transition temperature (hereinafter referred to as "Tg") of 80° C. or more, and an acrylic resin emulsion on the back surface of the support made of plastic film or synthetic paper, in order to obtain a thermosensitive recording material which is excellent in the anti-blocking in the storage as a roll, in antistatic property, and in adhesion property between the support and the layers, in which the adhesive does not peel off from the back surface even when water penetrates into the adhering surface.

JP-A No. 2004-98634 discloses a thermosensitive recording material containing an adhesive including a polyurethane resin adhesive and one of an acrylic resin adhesive having a Tg of 30° C. to 220° C. and an acrylamide resin adhesive wherein the amount of the polyurethane resin adhesive is 3% by mass to 30% by mass with respect to the whole amount of the adhesives, in order to obtain a thermosensitive recording material which causes no blocking when superposed on any surface and has excellent binding property.

JP-A No. 2006-289962 discloses a thermosensitive recording material excellent in antistatic property and binding property, which contains a copolymer of (meth)acryloyloxyalkylammonium salt and styrene in any of the coated layers, or which contains a copolymer of (meth)acryloyloxyalkylammonium salt and styrene and as an adhesive resin acrylic acid ester copolymer in the back layer.

In recent years, in order to reduce the cost for producing a plastic film and to improve glossiness of a film, a plastic film has been developed in which one side or both sides of the support is extremely smooth and glossy. However, the technique disclosed in any of the above-mentioned patent literature is not applicable for all types of plastic film support, and shows little or no effect when using a support having extremely smooth surface (for example, a smoothness of 5,000 seconds or more measured by Oken type tester), causing a problem that binding property of the layer with the support is so weak that the layers easily peels off and that an adhesive dissolves in water and peels off from the support.

BRIEF SUMMARY OF THE INVENTION

The object of the present invention is to provide a thermosensitive recording material having a polypropylene film support (excellent especially in smoothness and glossiness) and a back layer disposed on the support, in which the back layer is so strongly bound to the support that an adhesive is not peeled off by water penetrating into the adhesion surface when the recording material is used as a label having a release paper laminated on the back layer using an adhesive, and which is also excellent in an antistatic function, causing no blocking issue when the recording material is wound up.

The above problems are solved by the following:

<1> A thermosensitive recording material including:

a polypropylene film support;

a thermosensitive recording layer;

a protective layer; and a back layer, wherein the thermosensitive recording layer and the protective layer are disposed on a surface of the polypropylene film support, and the back layer is disposed on another surface of the polypropylene film support, wherein the back layer is a coated layer of a coating liquid including:

a self-crosslinking resin emulsion, which comprises a combination of at least one selected from a carbonyl group-containing acrylic resin having a Tg of 16° C. or lower and a copolymer polyester resin having a Tg of 16° C. or lower and a hydrazine derivative having a hydrazine residual group; and a quaternary ammonium polymer antistatic agent.

<2> The thermosensitive recording material according to <1>, wherein the quaternary ammonium polymer antistatic agent is a copolymer of (meth)acryloyloxyalkylammonium salt and styrene.

<3> The thermosensitive recording material according to any one of <1> and <2>, wherein a mixing ratio of the quaternary ammonium type polymer antistatic agent to the self-crosslinking resin is 0.1:1.0 to 1.0:1.0 on a mass basis.

<4> The thermosensitive recording material according to any one of <1> to <3>, wherein the back layer contains, as a plastic filler, a styrene-methacrylic acid copolymer in a state of emulsion.

<5> A thermosensitive recording label including:

a thermosensitive recording material according to any one of <1> to <4>;

an adhesive layer disposed on the thermosensitive recording material; and a release paper disposed on the adhesive layer.

According to the present invention, a thermosensitive recording material can be provided which has a polypropylene film support and a back layer disposed on the support, in which the back layer is so strongly bound to the support that an adhesive is not peeled off by water penetrating into the adhesion surface when the recording material is used as a label having a release paper laminated on the back layer using an adhesive, and which is also excellent in an antistatic function, causing no blocking issue when the recording material is wound up.

DETAILED DESCRIPTION OF THE INVENTION

Hereinafter, the aspects of the present invention are described in detail.

The thermosensitive recording material of the present invention contains a polypropylene film support, and a thermosensitive recording layer and a protective layer disposed on a surface of the polypropylene film support, and a back layer disposed on another surface of the polypropylene film support. The polypropylene film support is used because it is excellent in coating stability which is required in producing a thermosensitive recording material.

As the back layer, a self-crosslinking resin emulsion is used which includes one of a carbonyl group-containing acrylic resin having Tg of 16° C. or lower and a copolymerized polyester resin having Tg of 16° C. or lower, and a hydrazine derivative having a hydrazine residual group. Since the higher the Tg becomes, the lower the binding ability to the polypropylene film support becomes, the Tg is set to be 16° C. or lower. However, if the Tg is too lower, a coated layer is sticky after coated and dried, and also a blocking is likely to occur in a roll, it is preferable to use the emulsion having a Tg of −15° C. or higher.

To enhance the antistatic function, a commonly-used anionic polymer electrolyte such as sodium polystyrene sulfonate may be used in combination with the self-crosslinking resin, but the binding function is extremely lowered while the antistatic function is enhanced. Thus in place of the anionic polymer electrolyte, a quaternary ammonium polymer is used in combination as an antistatic agent so that antistatic property can be enhanced without lowering the adherence property to the polypropylene film support.

The above configuration enables to provide a thermosensitive recording material in which the back layer is so strongly bound to the polypropylene film support that an adhesive is not peeled off by water penetrating into the adhesion surface when the recording material is used as a label having a release paper disposed on the back layer using an adhesive, and which is also excellent in an antistatic function, causing no blocking when the recording material is wound up.

The carbonyl group-containing acrylic resin to be contained in the self-crosslinking resin emulsion is an acrylic copolymer containing acrylic acid or a derivative thereof and having a carbonyl group.

Examples of the acrylic monomer which constitutes the carbonyl group-containing acrylic resin include acrylic organic acids such as acrylic acid, methacrylic acid, maleic acid, and itaconic acid; (meth)acrylic acid hydroxyalkyl esters such as hydroxyethyl(meth)acrylate, 2-hydroxyethyl (meth)acrylate, 2-hydroxypropyl(meth)acrylate, and hydroxybutyl(meth)acrylate; sodium aminoalkyl(meth)acrylates, and acrylamides. However, the acrylic monomer is not limited to these examples.

Examples of other vinyl monomer capable of being copolymerized with the acrylic monomer include alkyl(meth) acrylate, phenyl(meth)acrylate, acrylonitrile, vinyl chloride, vinyl acetate, and styrene and a derivative thereof. However, the vinyl monomer is not limited to these examples.

The copolymerizable monomer to be used for introducing a carbonyl group into the acrylic copolymer include a carbonyl group-containing monomer that contains at least one aldo group or keto group and a polymerizable double bond, such as acrolein, and diacetoneacrylamide.

In the present invention, the Tg of the carbonyl group-containing acrylic resin is adjusted to 16° C. or lower by the selection and the ratio of a monomer of the acrylic copolymer.

The copolymer polyester resin is a polyester resin having a Tg of 16° C. or lower, consisting of dibasic acid and glycol, soluble in water, and capable of being emulsified or dispersed. Examples of the dibasic acid include a dicarboxylic acid in which a sulfonic acid metallic salt-containing dicarboxylic acid accounts for 50% by mole to 0.5% by mole of the whole dicarboxylic acid. The copolymerized polyester resin is a polyester copolymer formed by copolymerizing the dicarboxylic acid component and glycol component. Examples of the sulfonic acid metallic salt-containing dicarboxylic acid include a metallic salt of sulfoterephthalic acid, 5-sulfoisophthalic acid, 4-sulfophthalic acid, 4-sulfonaphthalen-2,7-dicarboxylic acid, and 5[4-sulfophenoxy]isophthalic acid. Of these, sodium 5-sulfoisophthalate and sodium sulfoterephthalate are preferable.

Examples of the hydrazine derivative include the dicarboxylic acid dihydrazide having 2-10, preferably 4-6 carbon atoms, such as oxalic acid dihydrazide, malonic acid dihydrazide, succinic acid dihydrazide, glutaric acid dihydrazide, adipic acid dihydrazide, isophthalic acid dihydrazide, sebacic acid dihydrazide, maleic acid dihydrazide, fumaric acid dihydrazide, itaconic acid dihydrazide, and C2-4 aliphatic water-soluble dihydrazides such as ethylene-1,2-dihydrazine. Of these, adipic acid dihydrazide, isophthalic acid dihydrazide, and sebacic acid dihydrazide are preferable.

As the quaternary ammonium salt polymer antistatic agent, it is preferable to use a copolymer containing, in addition to a quaternary ammonium salt, styrene or acrylic acid or a derivative thereof as a monomer component. Specific examples thereof include the polymer represented by General Formulas (1) to (3) shown below, which do not limit the present invention. Of these, a copolymer of (meth)acryloyloxyalkylammonium salt with styrene (for example, General Formula (1)) is more preferable in view of antistatic property.

General Formula (1)

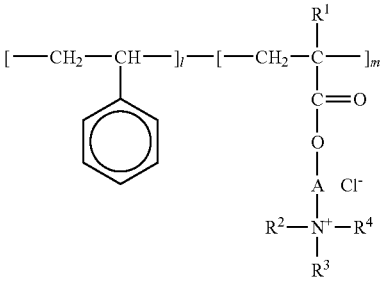

In General Formula (1), $R^1$ is a hydrogen atom or $CH_3$, $R^2$, $R^3$ and $R^4$ are the same or different from each other and are $CH_3$ or $C_2H_5$, A is —$(CH_2)_n$— (n stands for an integer of 1-3), and 1 and m each stand for an integer of 1-100.

General Formula (2)

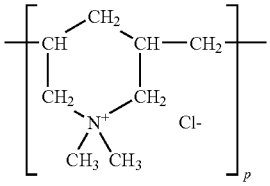

In General Formula (2), p stands for an integer of 1-100.

General Formula (3)

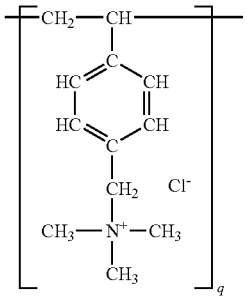

In General Formula (3), q stands for an integer of 1-100.

The mixing ratio (on dry basis) of the quaternary ammonium type polymer antistatic agent to the self-crosslinking resin is preferably 0.1:1.0 to 1.0:1.0 on a mass basis. At a ratio less than 0.1:1.0 on a mass basis, antistatic property is not obtained, while at a ratio exceeding 1.0:1.0 on a mass basis, the back layer easily dissolves into water.

In the back layer of the thermosensitive recording material of the present invention, it is preferable to incorporate a plastic filler for the purpose of improving binding property and water resistance of the adhesive. As such a filler, it is preferable to use a styrene-methacrylic acid copolymer resin in a state of emulsion because it has a chemical affinity with the support and an adhesive and has water resistance, and thus can achieve the purpose. The addition of the plastic filler to the back layer is preferable because the addition is highly effective for the anti-blocking at the time of storage as a roll form.

The mixing ratio (on dry basis) of the plastic filler to the self-crosslinking resin is preferably 1:1 to 1:4 on a mass basis. At a ratio less than 1:1 on a mass basis, antistatic property is not obtained, while at a ratio exceeding 1:4 on a mass basis, the adhesion property of the back layer is lowered.

The back layer may contain, if necessary, various materials known per se in the art, such as water-soluble polymer, water resistant agent, bulking agent, surfactant, thermoplastic substance, resinous micro balloon, and leveling agent.

The thermosensitive recording layer (thermosensitive coloring layer) in the present invention at least contains a color former and a color developer. As the color former, leuco dyes commonly used in the conventional thermosensitive recording material may be used solely or in combination of two or more.

As the leuco dye, a leuco compound of such as triphenyl methane dye, fluoran dye, phenotiazine dye, auramine dye, spiropyran dye, or indolinophthalide dye is preferably used. Specific examples thereof include the following: 3,3-bis-(p-dimethylaminophenyl)phthalide, 3,3-bis(p-dimethylaminophenyl)-6-dimethylaminophthalide (also known as "crystal violet lactone"), 3,3-bis(p-dimethylaminophenyl)-6-diethylaminophthalide, 3,3-bis(p-dimethylaminophenyl)-6-chlorophthalide, 3,3-bis(p-dibutylaminophenyl)phthalide, 3-cyclohexylamino-6-chlorofluoran, 3-dimethylamino-5,7-dimethylfluoran, 3-diethylamino-7-chlorofluoran, 3-diethylamino-7-methylfluoran, 3-diethylamino-7,3-benzofluoran, 3-diethylamino-6-methyl-7-chlorofluoran, 3-(N-p-tolyl-N-ethylamino)-6-methyl-7-anilinofluoran, 3-pyrrolidino-6-methyl-7-anilinofluoran, 2-[N-(3'-fluorotrimethylphenyl) amino]-6-diethylaminofluoran, 2-[3,6-bis(diethylamino)-9-(o-chloranilino)xanthyl benzoic acid lactam], 3-diethylamino-6-methyl-7-(m-trichloromethylanilino)fluoran, 3-diethylamino-7-(o-chloroanilino)fluoran, 3-di-n-butylamino-7-(o-chloroanilino)fluoran, 3-N-methyl-N-n-amylamino-6-methyl-7-anilinofluoran, 3-N-methyl-N-cyclohexylamino-6-methyl-7-anilinofluoran, 3-diethylamino-6-methyl-7-anilinofluoran, 3-(N,N-diethylamino)-5-methyl-7-(N,N-dibenzylamino)fluoran, benzoylleucomethyleneblue, 6'-chloro-8'-methoxy-benzoindolino-spyropyran, 6'-bromo-3'-methoxy-benzoindolinospyropyran, 3-(2'-hydroxy-4'-dimethylaminophenyl)-3-(2'-methoxy-5'-chlorophenyl) phthalide, 3-(2'-hydroxy-4'-dimethylaminophenyl)-3-(2'-methoxy-5'-nitrophenyl)phthalide, 3-(2'-hydroxy-4'-diethylaminophenyl)-3-(2'-methoxy-5'-methylphenyl) phthalide, 3-(2'-methoxy-4'-dimethylaminophenyl)-3-(2'-hydroxy-4'-chlor-5'-methylphenyl)phthalide, 3-(N-ethyl-N-tetrahydrofurfuryl)amino-6-methyl-7-anilinofluoran, 3-N-ethyl-N-(2-ethoxypropyl)amino-6-methyl-7-anilinofluoran, 3-N-methyl-N-isobutyl-6-methyl-7-anilinofluoran, 3-morpholino-7-(N-propyl-trifluoromethylanilino)fluoran, 3-pyrrolidino-7-m-trifluoromethylanilinofluoran, 3-diethylamino- 5-chloro-7-(N-benzyl-trifluoromethylanilino)fluoran, 3-pyrrolidino-7-(di-p-chlorophenyl)methylaminofluoran, 3-diethylamino-5-chloro-7-(α-phenylethylamino)fluoran, 3-(N-ethyl-p-toluidino)-7-(α-phenylethylamino)fluoran, 3-diethylamino-7-(o-methoxycarbonylphenylamino)fluoran, 3-diethylamino-5-methyl-7-(α-phenylethylamino)fluoran, 3-diethylamino-7-piperidinofluoran, 2-chloro-3-(N-methyltoluidino)-7-(p-n-butylanilino)fluoran, 3-(N-methyl-N-isopropylamino)-6-methyl-7-anilinofluoran, 3-di-n-butylamino-6-methyl-7-anilinofluoran, 3,6-bis(dimethylamino)fluorenespyro(9,3')-6'-dimethylaminophthalide, 3-(N-benzyl-N-cyclohexylamino)-5,6-benzo-7-α-naphthylamino-4'-bromofluoran, 3-diethylamino-6-chloro-7-anilinofluoran, 3-diethylamino-6-methyl-7-mesitydino-4',5'-benzofluoran, 3-N-methyl-3-isopropyl-8-methyl-7-anilinofluoran, 3-N-ethyl-N-isoamyl-6-methyl-7-anilinofluoran, and 3-diethylamino-6-methyl-7-(2',4'-dimethylanilino)fluoran.

As a developer, various electron-accepting substance known per se in the art capable of reacting with the leuco dye and making the leuco dye develop color when heated. Examples thereof include the phenolic substance, organic or inorganic acidic substance, or esters thereof or salts thereof. Specific examples include gallic acid, salicylic acid, 3-isopropyl salicylic acid, 3-cyclohexyl salicylic acid, 3,5-di-tert-butyl salicylic acid, 3,5-di-α-methylbenzyl salicylic acid, 4,4'-isopropylidenediphenol, 1,1'-isopropylidenebis(2-chlorophenol), 4,4'-isopropylidenebis(2,6-dibromophenol), 4,4'-isopropylidenebis(2,6-dichlorophenol), 4,4'-isopropylidenebis(2-methylphenol), 4,4'-isopropylidenebis(2,6-dimethylphenol), 4,4-isopropylidenebis(2-tert-butylphenol), 4,4'-sec-butylidenediphenol, 4,4'-cyclohexylidenebisphenol, 4,4'-cyclohexylidenebis(2-methylphenol), 4-tert-butylphenol, 4-phenylphenol, 4-hydroxydiphenoxide, α-naphthol, β-naphthol, 3,5-xylenol, thymol, methyl-4-hydroxybenzoate, 4-hydroxyacetophenone, novolac-type phenol resins, 2,2'-thiobis(4,6-dichlorophenol), catechol, resorcin, hydroquinone, pyrogallol, phloroglycine, phloroglycinecarboxylic acid, 4-tert-octylcatechol, 2,2'-methylenebis(4-chlorophenol), 2,2'-methylenebis(4-methyl-6-tert-butylphenol), 2,2-dihydroxydiphenyl, ethyl p-hydroxybenzoate, propyl p-hydroxybenzoate, butyl p-hydroxybenzoate, benzyl p-hydroxybenzoate, p-chlorobenzyl p-hydroxybenzoate, o-chlorobenzyl p-hydroxybenzoate, p-methylbenzyl p-hydroxybenzoate, n-octyl p-hydroxybenzoate, benzoic acid, zinc salicylate, 1-hydroxy-2-naphthoic acid, 2-hydroxy-6-naphthoic acid, zinc 2-hydroxy-6-naphthoate, 4-hydroxydiphenylsulfone, 4-hydroxy-4'-chlorodiphenylsulfone, bis(4-hydroxyphenyl)sulfide, 2-hydroxy-p-toluic acid, zinc 3,5-di-tert-butylsalicylate, tin 3,5-di-tert-butylsalicylate, tartaric acid, oxalic acid, maleic acid, citric acid, succinic acid, stearic acid, 4-hydroxyphthalic acid, boric acid, thiourea derivatives, 4-hydroxythiophenol derivatives, bis(4-hydroxyphenyl)acetic acid, bis(4-hydroxyphenyl)ethyl acetate, bis(4-hydroxyphenyl)-n-propyl acetate, bis(4-hydroxyphenyl)-m-butyl acetate, bis(4-hydroxyphenyl)phenyl acetate, bis(4-hydroxyphenyl)benzyl acetate, bis(4-hydroxyphenyl)phenethyl acetate, bis(3-methyl-4-hydroxyphenyl)acetic acid, bis(3-methyl-4-hydroxyphenyl)methyl acetate, bis(3-methyl-4-hydroxyphenyl)-n-propyl acetate, 1,7-bis(4-hydroxyphenylthio)-3,5-dioxaheptane, 1,5-bis(4-hydroxyphenylthio)-3-oxaheptane, dimethyl 4-hydroxyphthalate, 4-hydroxy-4'-methoxydiphenylsulfone, 4-hydroxy-4'-ethoxydiphenylsulfone, 4-hydroxy-4'-isopropoxydiphenylsulfone, 4-hydroxy-4'-propoxydiphenylsulfone, 4-hydroxy-4'-butoxydiphenylsulfone, 4-hydroxy-4'-isobutoxydiphenylsulfone, 4-hydroxy-4-butoxydiphenylsulfone, 4-hydroxy-4'-tert-butoxydiphenylsulfone, 4-hydroxy-4'-benzyloxydiphenylsulfone, 4-hydroxy-4'-phenoxydiphenylsulfone, 4-hydroxy-4'-(m-methylbenzyloxy)diphenylsulfone, 4-hydroxy-4'-(p-methylbenzyloxy)diphenylsulfone, 4-hydroxy-4'-(o-methylbenzyloxy)diphenylsulfone and 4-hydroxy-4'-(p-chlorobenzyloxy)diphenylsulfone.

In the thermosensitive recording layer of the present invention, if necessary, supplemental additives commonly used for the conventional thermosensitive recording material, such as a water-soluble polymer, an aqueous emulsion resin, a filler, a thermofusible material and a surfactant and the like, may also be contained together with the leuco dye and the developer.

Examples of the filler include fine inorganic powders of potassium carbonate, silica, zinc oxide, titanium oxide, aluminum hydroxide, zinc hydroxide, barium sulfate, clay, talc, surface-treated potassium and surface-treated silica; and fine organic powders of urea-formalin resins, styrene-methacrylic acid copolymers and polystyrene resins.

Examples of the thermofusible material include higher fatty acids, and esters thereof, amides and metal salts thereof; waxes; condensation products of aromatic carboxylic acids and amines; benzoic acid phenyl esters; higher straight-chain glycols; 3,4-epoxy-dialkyl hexahydrophthalate; higher ketones; p-benzylbiphenyl; and other thermofusible organic compounds having melting points of approximately 50° C. to 200° C.

As to the thermosensitive recording material of the present invention, a protective layer is provided on the thermosensitive recording layer for the purpose of, for example, improving the capability of the thermosensitive recording material to match a thermal head or the like and further enhancing the storage stability of a recorded image.

Examples of the resin used in the protective layer include water-soluble resins such as polyvinyl alcohol, cellulose derivatives, starch and derivatives thereof, carboxy group-modified polyvinyl alcohol, polyacrylic acid and derivatives thereof, styrene-acrylic acid copolymers and derivatives thereof, poly(meth)acrylamide and derivatives thereof, styrene-acrylic acid-acrylamide copolymers, amino-group-modified polyvinyl alcohol, epoxy-modified polyvinyl alcohol, polyethyleneimine, water-soluble polyesters, water-soluble polyurethane, and isobutylene-maleic anhydride copolymers and derivatives thereof; polyesters, polyurethane, acrylic acid ester (co)polymers, styrene-acrylic copolymers, epoxy resins, polyvinyl acetate, polyvinylidene chloride, polyvinyl chloride and copolymers thereof. Of these, water-soluble resins are preferred.

The protective layer may contain, in addition to the above-mentioned resins, supplemental additives conventionally used, such as a filler, a surfactant, a thermofusible material (or lubricant), a pressure-based color development preventing agent etc., and further a water-resistant agent. The filler and the thermofusible material to be used for the protective layer may be the same as those recited as examples to be used in the thermosensive recording layer.

As to the thermosensitive recording material of the present invention, a protective layer is provided on the thermosensitive recording layer for the purpose of, for example, improving the capability of the thermosensitive recording material to match a thermal head or the like and further enhancing the storage stability of a recorded image.

As a material for the protective layer, it is preferable to use polyvinyl alcohol to prevent colored images from vanishing due to the penetration of oils, plasticizers or alcohols. Examples of the alcohols include perfectly saponified or partially saponified polyvinyl alcohol or polyvinyl alcohol modified with carboxy group, amino group, or the like.

Examples of the resin usable in combination with polyvinyl alcohol include water-soluble resins such as cellulose derivatives, starch and derivatives thereof, polyacrylic acid and derivatives thereof, styrene-acrylic acid copolymers and derivatives thereof, poly(meth)acrylamide and derivatives thereof, styrene-acrylic acid-acrylamide copolymers, polyethyleneimine, water-soluble polyesters, water-soluble polyurethane, and isobutylene-maleic anhydride copolymers and derivatives thereof, polyesters, polyurethanes, acrylic acid ester (co)polymers, styrene-acrylic copolymers, epoxy resins, polyvinyl acetate, polyvinylidene chloride, and polyvinyl chloride and copolymers thereof. Of these, water-soluble resins are preferred.

The protective layer may contain, in addition to the above-mentioned resins, supplemental additives conventionally used, such as a filler, a surfactant, a thermofusible material (or lubricant), a pressure-based color development preventing agent etc., and further a water-resistant agent.

The protective layer may contain, in addition to the above-mentioned resins, supplemental additives conventionally used, such as a filler, a surfactant, a thermofusible material (or lubricant), a pressure-based color development preventing agent etc., and further a water-resistant agent.

As the filler to be used in the protective layer, a conventionally-used filler may be used without any limitation. Examples thereof include inorganic pigments such as calcium carbonate, zinc oxide, aluminum oxide, titanium dioxide, silica, aluminum hydroxide, barium sulfate, talc, kaolin, alumina, clay, and the like; and known organic pigments.

As a water-resistant agent (a cross-linking agent) to be used in the present invention, known cross-linking agents such as glyoxal, melamine, aziridine compound, polyamide epichlorohydrin resin, zirconium ammonium carbonate, ethylene diamine, hydrazide compound, and the like may be used in combination so far as its function is not impaired.

Examples of the surfactant include a metallic soap of fatty acid, a polycarboxylic acid polymer surfactant, a sulfuric acid ester salt of higher alcohol, a sulfuric acid ester salt of alkyl polyether, an ethylene oxide adduct of higher alcohol, an alkylaryl sulfonate, an alkyl sulfonate, an aryl sulfonate, a phosphate, an aliphatic phosphate, an aromatic phosphate, a polyoxyethylene alkyl phosphate, a polyoxyethylene aryl phosphate, a polyoxyethylene alkylaryl phosphate, a dialkyl sulfosuccinate, an alkylbenzene sulfonate, a polyoxyalkylene alkylether phosphate, a polyoxyalkylene arylether phosphate, a polyoxy alkylene alkylarylether phosphate, a sodium alkyl sulfate, a sodium dioctyl sulfosuccinate, a polyalkylene glycol (for example, a polyoxyethylene nonylphenylether), acetylene glycol, an ethylene oxide adduct of acetylene glycol, a propylene oxide adduct of acetylene glycol, an ethylene oxide and propylene oxide adduct of acetylene glycol, and the like.

Examples of the lubricant include a higher fatty acid and a metallic salt thereof, a higher fatty acid amide, a higher fatty acid ester, and various waxes of animal, plant, mineral or petroleum origin.

The thermosensitive recording material of the present invention can be produced by applying coating liquids for forming the above-mentioned layers onto the polypropylene film support, and by drying the thus coated matter.

EXAMPLES

Hereinafter, the present invention will be described in more detail by referring to the Examples, but the Examples should not be construed as limiting the present invention. The "part" or "parts" and "%" are respectively "part by mass" or "parts by mass" and "% by mass".

Example 1

(1) Preparation of the Coating Liquid for the Thermosensitive Recording Layer

Each mixture of materials for preparing each of [Solution A] and [Solution B] as shown below was pulverized using a sand mill such that the average particle diameter became 2 μm or less.

Next, [Solution A] (50 parts) and [Solution B] (10 parts) were mixed under stirring to thereby prepare a coating liquid for the thermosensitive recording layer.

| [Solution A] | |
|---|---|
| 2-anilino-3-methyl-6-dibutylaminofluoran: | 20 parts |
| polyvinyl alcohol (produced by Kuraray Co., Ltd., KL-318, solid content: 10%): | 20 parts |
| water: | 60 parts |

| [Solution B] | |
|---|---|
| 4-hydroxy-4'-isopropoxydiphenylsulfon: | 15 parts |
| silica (produced by Mizusawa Industrial Chemicals, Ltd.; MIZUKASIL): | 15 parts |
| polyvinyl alcohol (produced by Kuraray Co., Ltd., KL-318, solid content: 10%): | 20 parts |
| water: | 50 parts |

(2) Preparation of the Coating Liquid for the Protective Layer

The following materials were mixed under stirring to prepare the coating liquid for the protective layer.

| | |
|---|---|
| aluminum hydroxide (produced by Showa Denko K.K., HIGILITE): | 33 parts |
| polyvinyl alcohol (produced by Kuraray Co., Ltd., KL-318, solid content: 10%): | 37 parts |
| polyamide epichlorhydrin resin (produced by Seiko PMC corporation; paper durability reinforcer WS-525, solid content: 25%): | 9 parts |
| water: | 21 parts |

(3) Preparation of the Coating Liquid for the Back Layer

The following materials were mixed under stirring to prepare the coating liquid for the back layer.

| | |
|---|---|
| self-crosslinking acrylic resin emulsion (produced by BASF Japan; YJ-2720D, Tg of the self-crosslinking acrylic resin: 9° C., solid content: 48%): | 21 parts |
| antistatic agent: stylene-quaternary ammonium salt polymer (produced by Sanyo Chemical Industries, Ltd.: CHEMISTAT6300, solid content: 33%): | 15 parts |
| water: | 74 parts |

Next, on the front surface of a support made of polypropylene film having a thickness of 90 μm, a smoothness of 5,000 seconds or more measured by Oken type tester, a glossiness of 80% or more (a film made by laminating a polypropylene film having a thickness of 70 μm to 85 μm (PL-90, produced by Nan Ya plastics corporation) and a biaxial-oriented polypropylene films containing 10% by mass to 50% by mass of calcium carbonate powder), a thermosensitive recording layer and a protective layer were coated with the above-mentioned coating liquids, followed by drying such that the coated amounts after dried were 5.0 g/m$^2$, and 3.5 g/m$^2$, respectively. Likewise, on the back surface of the support was coated with the above-mentioned coating liquid for the back layer, followed by drying, such that the coated amount after dried was 1.0 g/m$^2$. Thus the thermosensitive recording material was obtained.

Next, the surface of the protective layer was calendered so as to obtain a surface smoothness of 800 seconds to 1,000 seconds.

Subsequently, a peeling backing paper was laminated using an acrylic adhesive (produced by Toyo Ink Mfg. Co., Ltd.; BPW6111), and the laminated product was stored for seven days at 30° C., whereby a thermosensitive recording label using an acrylic adhesive was yielded.

Example 2

A thermosensitive recording label was obtained in the same manner as in Example 1, except that the antistatic agent was changed to copolymer of methacroyloxyethyltrimethylammonium chloride and styrene (solid content: 40.5%) and the amount thereof was changed to 12 parts.

Example 3

A thermosensitive recording label was obtained in the same manner as in Example 2, except that the self-crosslinking acrylic resin emulsion was changed to YJ-2727D produced by BASF Japan Ltd., and the Tg and the solid content of the self-crosslinking acrylic resin was changed to 16° C. and 48%, respectively.

Example 4

Preparation of the Coating Liquid for the Back Layer

The following materials were mixed under stirring to obtain a coating liquid for the back layer.

| | |
|---|---|
| self-crosslinking acrylic resin emulsion (produced by BASF Japan Ltd., YJ-2720D, Tg and the solid content of the self-crosslinking acrylic resin were 9° C. and 48%, respectively): | 21 parts |
| antistatic agent: copolymer of methacryloyloxyethyltrimethylammonium chloride and styrene (solid content: 40.5%): | 12 parts |
| powder of aluminum hydroxide (produced by Showa Denko K.K.; HIGILITE H-43M, average particle diameter: 0.8 μm): | 10 parts |
| water: | 57 parts |

Subsequently, a thermosensitive recording label was obtained in the same manner as in Example 1, except that the coating liquid was changed to the above coating liquid and the coated amount of the back layer after dried was changed to 1.7 g/m$^2$.

Example 5

Preparation of the Coating Liquid for the Back Layer

The following materials were mixed under stirring to obtain a coating liquid for the back layer.

| | |
|---|---|
| self-crosslinking acrylic resin emulsion (produced by BASF Japan Ltd., YJ-2720D, Tg and the solid content of the self-crosslinking acrylic resin were 9° C. and 48%, respectively): | 21 parts |
| antistatic agent: copolymer of methacryloyloxyethyltrimethylammonium chloride and styrene (solid content: 40.5%): | 12 parts |
| styrene-methacrylic acid copolymer (produced by Mitsui Chemicals, Inc.; ALMATEX PP-1, solid content: 40%): | 25 parts |
| water: | 42 parts |

Subsequently, a thermosensitive recording label was obtained in the same manner as in Example 1, except that the coating liquid was changed to the above coating liquid and the coated amount of the back layer after dried was changed to 1.7 g/m$^2$.

Example 6

A thermosensitive recording label was obtained in the same manner as in Example 5, except that the amount of the antistatic agent was changed to 2.5 parts, and the coated amount of the back layer after dried was changed to 1.4 g/m$^2$.

Example 7

A thermosensitive recording label was obtained in the same manner as in Example 5, except that the amount of the antistatic agent was changed to 25 parts, and the coated amount of the back layer after dried was changed to 2.0 g/m$^2$.

Comparative Example 1

Preparation of Coating Liquid for the Back Layer

The following materials were mixed under stirring to obtain a coating liquid for the back layer.

| | |
|---|---|
| self-crosslinking acrylic resin emulsion (produced by BASF Japan Ltd., YJ-2720D, the Tg and the solid content of the self-crosslinking acrylic resin were 9° C. and 48%, respectively): | 21 parts |
| antistatic agent: polystyrenesulfonic acid ammonium salt (produced by Sanyo Chemical Industries, Ltd.; CHEMISTAT SA-101, solid content: 33%): | 15 parts |
| water: | 64 parts |

Next, a thermosensitive recording label was prepared in the same manner as in Example 1, except that the coating liquid for the back layer was changed to the above-mentioned coating liquid for the back layer.

Comparative Example 2

A thermosensitive recording label was prepared in the same manner as in Example 2, except that the self-crosslinking acrylic resin emulsion was changed to YJ-2716D produced by BASF Japan Ltd., and the Tg and the solid content of the self-crosslinking acrylic resin were changed to 25° C. and 48%, respectively.

Comparative Example 3

A thermosensitive recording label was obtained in the same manner as in Example 2, except that the self-crosslinking acrylic resin emulsion was changed to a non-self-crosslinking acrylic resin emulsion (produced by Johnson polymer; JONCRYL511, solid content: 45%), and the amount added was changed to 22 parts.

The conditions of preparing Examples 1-7 and Comparative Examples 1-3 were summarized in Table 1.

With respect to the each of the above-described thermosensitive recording labels, the tests (1) to (3) shown below were carried out.

The results are shown in Table 2. Table 2 reveals that the thermosensitive recording label of the present invention is high in binding property to a polypropylene film, excellent in antistatic property, and excellent in water resistance when it is bound.

(1) Binding strength (binding property): CELLOTAPE was attached to the back surface of each of the thermosensitive recording label and then peeled off from the back surface, and whether the back layer was peeled off or not was observed by visual inspection.

A: No peeling was observed.

B: Little peeling was observed.

C: Peeling of the adhesive with resistance was observed.

D: Peeling of the adhesive without resistance was observed.

(2) Charging property during printing: Under the conditions of temperature 5° C. and humidity 30%, the printing was made to each of the thermosensitive recording label by using a thermal printer DATAMAX I-4308, and the electric potential of the electric charge (unit:volt) on the back surface of the thermosensitive recording label immediately after the print out was measured by a static electricity sensor (produced by Sumitomo 3M Limited, TYPE718).

A: Electric potential was less than 500 V.

B: Electrical potential was 500 V or more but less than 1,000 V.

C: Electrical potential was 1,000 V or more but less than 2,000 V.

D: Electrical potential was 2,000 V or more.

(3) Water resistance of the label bound by acrylic adhesive: The release paper of each of the thermosensitive recording labels was peeled and the resultant label was dipped in water at room temperature for six hours, and then surface of the adhesive layer was scratched ten times by a finger to observe the degree of peeling of the adhesive by visual inspection.

A: No peeling was observed.

B: Little peeling was observed.

C: Peeling of the adhesive with resistance was observed.

D: Peeling of the adhesive without resistance was observed.

TABLE 1

| | Resin | Antistatic agent | Mass ratio of resin/antistatic agent on dry basis | Filler added |
|---|---|---|---|---|
| Example 1 | Self-crosslinking acryl (Tg: 9° C.) | Styrene quaternary ammonium salt | 1.0/0.5 | None |
| Example 2 | Self-crosslinking acryl (Tg: 9° C.) | Quaternary ammonium salt-contaning acryl | 1.0/0.5 | None |
| Example 3 | Self-crosslinking acryl (Tg: 16° C.) | Quaternary ammonium salt-contaning acryl | 1.0/0.5 | None |
| Example 4 | Self-crosslinking acryl (Tg: 9° C.) | Quaternary ammonium salt-contaning acryl | 1.0/0.5 | Aluminum hydroxide |
| Example 5 | Self-crosslinking acryl (Tg: 9° C.) | Quaternary ammonium salt-contaning acryl | 1.0/0.5 | Styrene/methacrylic acid copolymer |
| Example 6 | Self-crosslinking acryl (Tg: 9° C.) | Quaternary ammonium salt-contaning acryl | 1.0/0.1 | Styrene/methacrylic acid copolymer |
| Example 7 | Self-crosslinking acryl (Tg: 9° C.) | Quaternary ammonium salt-contaning acryl | 1.0/1.0 | Styrene/methacrylic acid copolymer |
| Com. Ex. 1 | Self-crosslinking acryl (Tg: 9° C.) | Polystyrenesulfonic acid ammonium salt | 1.0/0.5 | None |
| Com. Ex. 2 | Self-crosslinking acryl (Tg: 25° C.) | Quaternary ammonium salt-contaning acryl | 1.0/0.5 | None |
| Com. Ex. 3 | Acryl resin emulsion | Quaternary ammonium salt-contaning acryl | 1.0/0.5 | None |

TABLE 2

| | Binding strength | Charge during printing | Water resistance of sticking label |
|---|---|---|---|
| Example 1 | B | B | B |
| Example 2 | A | B | B |
| Example 3 | B | B | B |
| Example 4 | A | B | A |
| Example 5 | A | B | A |
| Example 6 | A | C | A |
| Example 7 | B | A | B |
| Com. Ex. 1 | D | B | C |
| Com. Ex. 2 | D | B | C |
| Com. Ex. 3 | D | B | D |

What is claimed is:

1. A thermosensitive recording material comprising:

a polypropylene film support;

a thermosensitive recording layer;

a protective layer; and a back layer, wherein the thermosensitive recording layer and the protective layer are disposed on a surface of the polypropylene film support, and the back layer is disposed on another surface of the polypropylene film support, wherein the back layer is a coated layer of a coating liquid comprising:

a self-crosslinking resin emulsion, which comprises a combination of at least one selected from a carbonyl group-containing acrylic resin having a Tg of 16° C. or lower and a copolymer polyester resin having a Tg of 16° C. or lower and a hydrazine derivative having a hydrazine residual group; and a quaternary ammonium polymer antistatic agent.

2. The thermosensitive recording material according to claim 1, wherein the quaternary ammonium polymer antistatic agent is a copolymer of (meth)acryloyloxyalkylammonium salt and styrene.

3. The thermosensitive recording material according to claim 1, wherein a mixing ratio of the quaternary ammonium polymer antistatic agent to the self-crosslinking resin is 0.1:1.0 to 1.0:1.0 on a mass basis.

4. The thermosensitive recording material according to claim 1, wherein the back layer comprises, as a plastic filler, a styrene-methacrylic acid copolymer in a state of emulsion.

5. A thermosensitive recording label comprising:

a thermosensitive recording material;

an adhesive layer disposed on the thermosensitive recording material; and a release paper disposed on the adhesive layer, wherein the thermosensitive recording material comprises a polypropylene film support, a thermosensitive recording layer, a protective layer, and a back layer, wherein the adhesive layer is disposed on the back layer, wherein the thermosensitive recording layer and the protective layer are disposed on a surface of the polypropylene film support, and the back layer is disposed on another surface of the polypropylene film support, wherein the back layer is a coated layer of a coating liquid which comprises a self-crosslinking resin emulsion, which comprises a combination of at least one selected from a carbonyl group-containing acrylic resin having a Tg of 16° C. or lower and a copolymer polyester resin having a Tg of 16° C. or lower and a hydrazine derivative having a hydrazine residual group; and a quaternary ammonium polymer antistatic agent.

* * * * *